US006370836B1

(12) United States Patent
Gunn

(10) Patent No.: US 6,370,836 B1
(45) Date of Patent: Apr. 16, 2002

(54) FLOOR BOARD COMPRESSION APPARATUS

(76) Inventor: Dalen Eugene Gunn, 3390 W. Hayden Ave., Rathdrum, ID (US) 83858

( * ) Notice: Subject to any disclaimer, the term of this patent is extended or adjusted under 35 U.S.C. 154(b) by 0 days.

(21) Appl. No.: 09/645,289

(22) Filed: Aug. 24, 2000

(51) Int. Cl.[7] ..... E04F 21/22

(52) U.S. Cl. ..... 52/749.1; 52/747.1; 52/DIG. 1; 52/127.5; 81/46; 269/904

(58) Field of Search ..... 52/749.1, 127.2, 52/127.5, 127.8, 127.9, DIG. 1; 81/44, 46; 269/43, 55, 904, 900

(56) References Cited

U.S. PATENT DOCUMENTS

| | | | |
|---|---|---|---|
| 999,641 | A | 8/1911 | Fuerst |
| 1,094,449 | A | 4/1914 | Lauri |
| 2,247,780 | A | 7/1941 | Klammt |
| 3,881,694 | A | 5/1975 | Gardner |
| D259,327 | S | 5/1981 | Sloane |
| 4,552,345 | A | 11/1985 | Benda et al. |
| 4,753,426 | A | 6/1988 | Varkala |
| 4,986,043 | A | 1/1991 | Love |
| 5,190,266 | A | 3/1993 | Barrera |
| 5,401,354 | A | 3/1995 | Colucci |
| 5,788,221 | A | 8/1998 | Muhlebach et al. |
| 5,894,705 | A | 4/1999 | Sutton |
| 5,946,785 | A | 9/1999 | Muhlebach et al. |

FOREIGN PATENT DOCUMENTS

| | | |
|---|---|---|
| DE | 4304992 | 2/1993 |
| WO | WO91/12114 | 8/1991 |

*Primary Examiner*—Carl D. Friedman
*Assistant Examiner*—Jennifer I. Thissell
(74) *Attorney, Agent, or Firm*—Gene Scott-Patent Law & Venture Group

(57) ABSTRACT

An apparatus for compressing floor boards, the apparatus comprising a first plate including a first edge gripping device for gripping an edge of a first floor board, and a compression biasing device such as a coil spring or bungee cord mounted on the first plate. A second plate includes a second edge gripping device for gripping an edge of a second floor board, and a strap clamp. A compression strap is joined at its proximal end with the biasing device and extends, in parallel juxtaposition to the first and second floor boards, for terminating, and removably engaging the strap clamp, such that the biasing device causes the first and second plates to draw the first and second floor boards, as well as any intermediate boards, into compression.

9 Claims, 4 Drawing Sheets

FLOOR BOARD COMPRESSION APPARATUS

BACKGROUND OF THE INVENTION

1. Field of the Invention

This invention relates generally to compressing devices and more particularly to an apparatus for effectively compressing floor boards during installation thereof.

2. Description of Related Art

The following art defines the present state of this field:

Fuerst U.S. Pat. No. 999,641 teaches a chalk line reel with spring loaded rewind mechanism.

Lauri U.S. Pat. No. 1094,449 teaches floor board pushing device.

Klammt U.S. Pat. No. 2,247,780 teaches a hand tool for clamping onto a board for lifting or carrying it.

Gardner U.S. Pat. No. 3,881,694 teaches a hold down device using flexible straps.

Benda et al U.S. Pat. No. 4,552,345 teaches a compression clamp.

Varkala U.S. Pat. No. 4,753,426 teaches a clamping device commonly known as a "comealong."

Love U.S. Pat. No. 4,986,043 teaches a lever arm tightening device for moving a wall frame.

Barrera U.S. Pat. No. 5,190,266 teaches a decking clamping device.

Colucci U.S. Pat. No. 5,401,354 teaches a multipurpose clamping apparatus.

Muhlebach et al U.S. Pat. No. 5,788,221 teaches a pneumatic arm actuated floor board clamping device.

Sutton U.S. Pat. No. 5,894,705 teaches suction or edge gripping devices for a coil spring biasing means.

Muhlebach et al U.S. Pat. No. 5,946,785 teaches a pressure jaw for installing floor panels.

Sloane U.S. Des. Pat. No. 259,327 teaches a design for a woodworking clamp.

Volker et al DE 4304992A1 teaches a floor board clamp with arm actuated sliding member.

Lichtenberg WO 91/121114 teaches a clamp with pivoting and sliding jaws.

The prior art teaches several method for drawing floor boards together and for holding them in place during setting. It also teaches the use of flexible straps, reel means and other features known to the prior art and in commercial use. However, the prior art does not teach the use of a two piece biasing fixture that is simple in construction, easy to use and inexpensive to produce. The present invention fulfills these needs and provides further related advantages as described in the following summary.

SUMMARY OF THE INVENTION

The present invention teaches certain benefits in construction and use which give rise to the objectives described below.

The present invention is used for compressing floor boards such as are laid as hardwood overlays in commercial and residential buildings. The invention apparatus comprises a first flat plate including a first flange for gripping an edge of one of the floor boards (workpiece), and a compression biasing device such as a coil spring or bungee cord mounted on the first plate. A second plate also provides the floor board gripping device and a strap clamp. A compression strap joins at its proximal end with the biasing device and extends, in parallel juxtaposition to the floor boards, for terminating, and removably engaging the strap clamp. The biasing device causes the first and second plates to draw the floor boards into compression for efficient mounting of the boards. Advantages of the present invention include: that it provides a constant pressure to floor boards even as the joints come together, once the device is set in place no further adjustment is required, the device provides repeated application of pressure each time it is used, the time required to operate the device is relatively short compared to prior art devices, and over compression of floor joints is eliminated.

The primary objective of the present invention is to provide a floor board compressing device having advantages not taught by the prior art.

Another objective is to provide such an invention capable of inexpensive manufacture and yet providing effective compressive forces.

A further objective is to provide such an invention adaptable to a wide range of work requirements by using various length compressing straps.

A still further objective is to provide such an invention that is very light in weight and stores compactly.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

Figure 1:
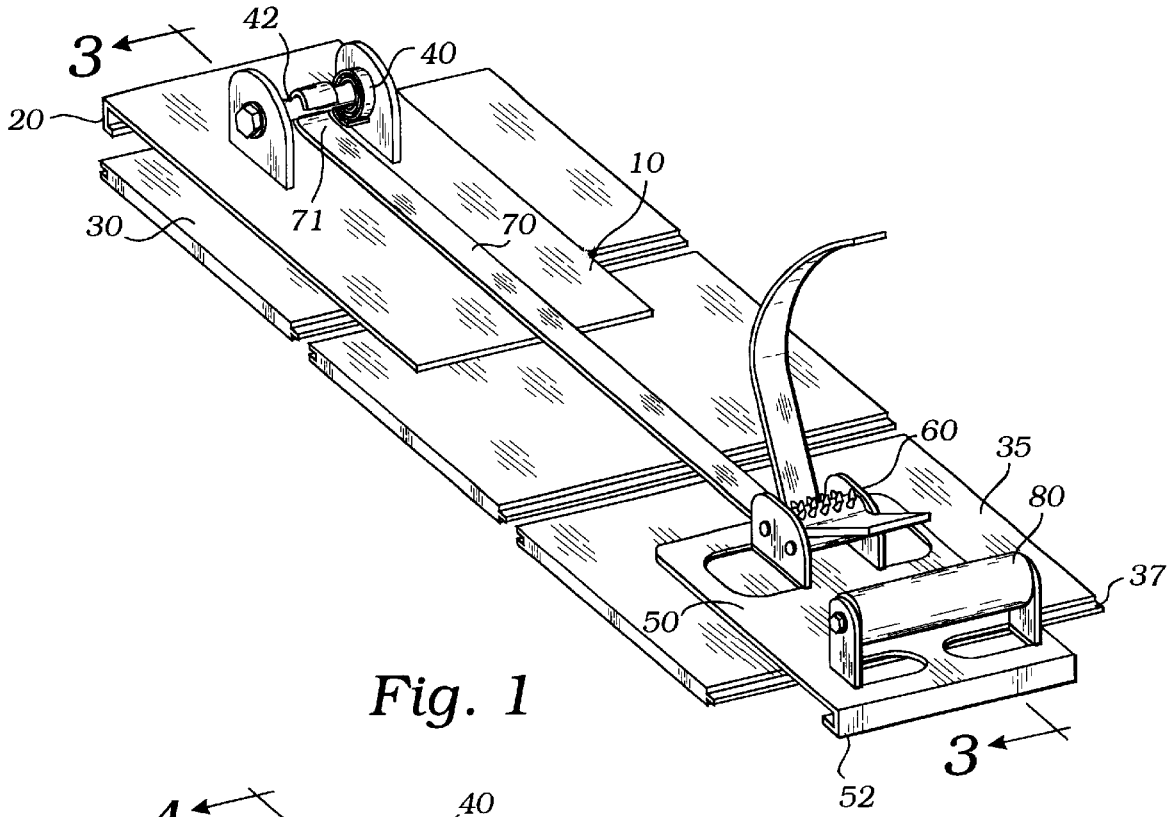
FIG. 1 is a perspective view of a preferred embodiment of the present invention.

The above described drawing FIGS. 1–5 illustrate the invention, an apparatus for compressing floor boards.

The apparatus comprises a first plate 10 including a first edge gripping means 20 such as the flange shown in the figures for gripping an edge 32 of a first floor board 30. First plate 10 is preferably made of sheet stock metal. A compression biasing means 40 is mounted, by welding, brazing or common fastener means, for accessibility on the first plate 10 as clearly shown in FIG. 1. A second plate 50 of the same type as the first plate 10, includes a second edge gripping means 52 for gripping an edge 37 of a second floor board 35, and provides a strap clamping means 60, of generally any common type, which is mounted on the second plate 50 again, by common fastening means.

A compression strap 70 generally made of nylon or other non-stretchable and flexible material, is joined at a proximal end 71 thereof with the biasing means 40 and extends in parallel to the first and second floor boards 30, 35, i.e., the upfacing surfaces thereof, and terminates at the strap clamping means 60 where it is removably and adjustably, as to position, engaged. The biasing means 40 causes the first and second plates 10, 50 to draw the first and second floor boards 30, 35 into compression therebetween so that they move from positions shown in FIGS. 1 and 3, to positions shown in FIGS. 2 and 4 where, for instance, tongue in groove boards, such as are shown in the figures, are engaged. The clamping force exerted may be almost any magnitude desired depending on the spring constant of the biasing means 40.

Figure 2:
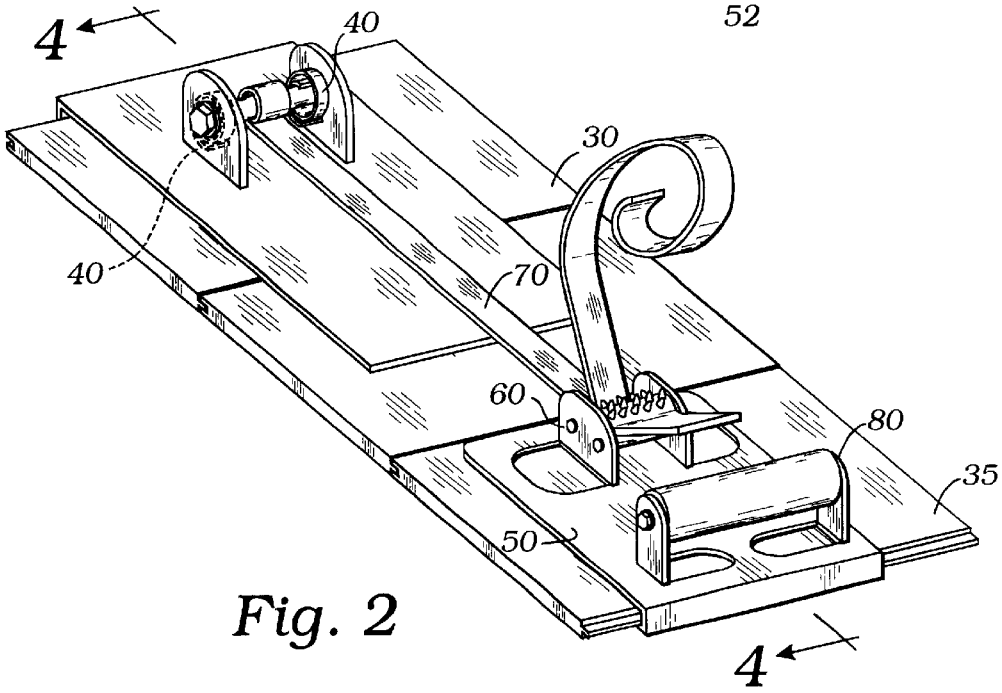
FIG. 2 is a further perspective view demonstrating the method of use thereof.
Figure 3:
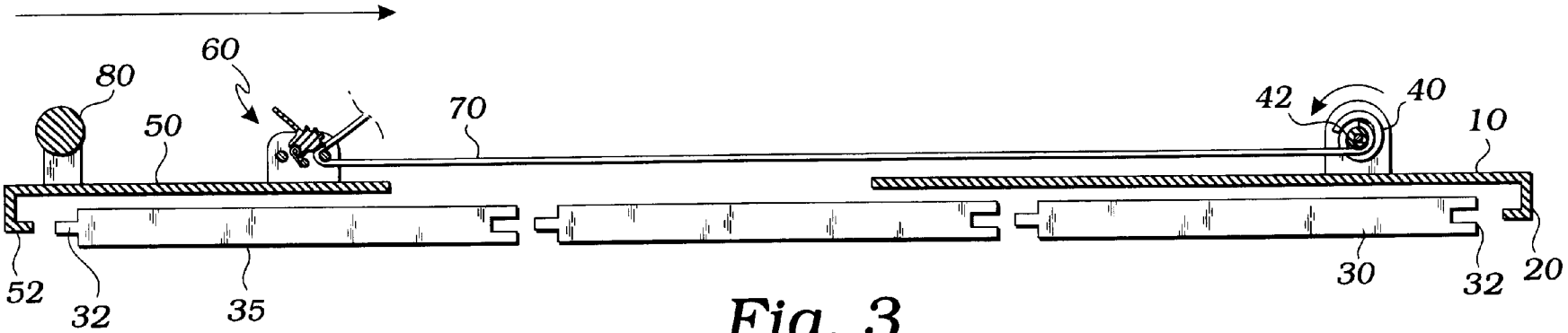
FIGS. 3 and 4 are sectional side elevational views thereof taken along lines 3—3 and 4—4 in FIGS. 1 and 2 respectively.
Figure 4:
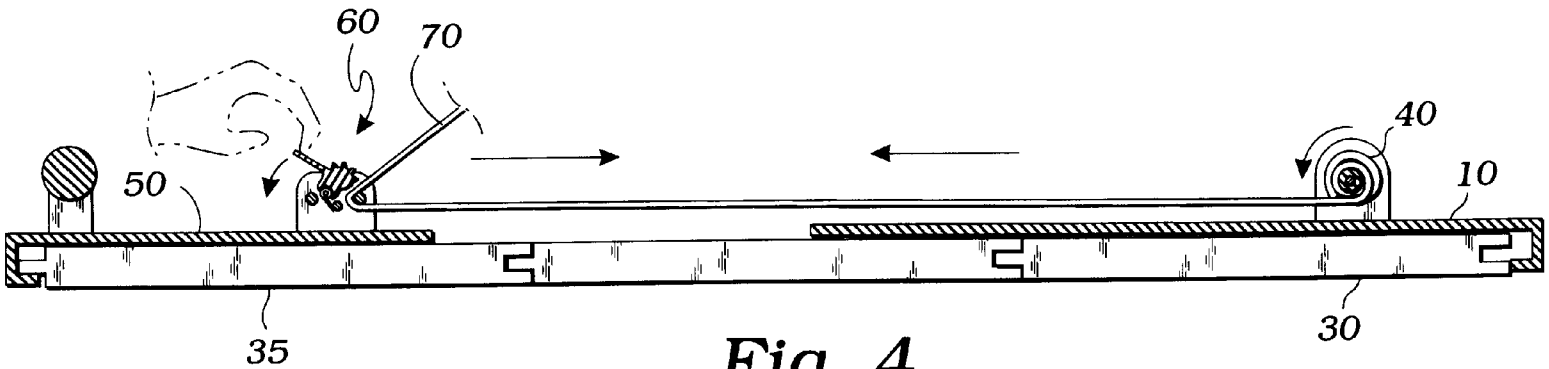
Figure 5:
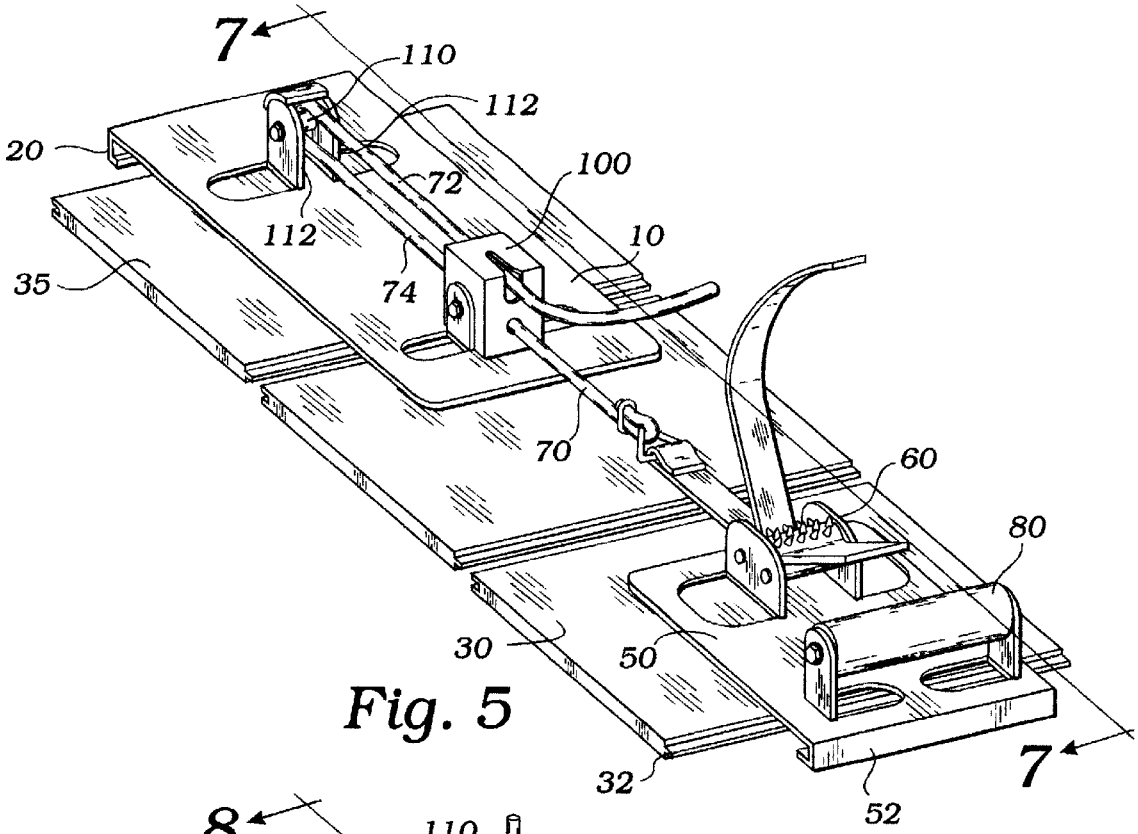
FIG. 5 is a perspective view of a further preferred embodiment of the present invention.

The biasing means 40 may take several forms as shown in FIGS. 1 and 5. As in FIGS. 1–4 it may be one or two coil springs, spaced apart and engaged with a free axle 42 wherein the coil springs are functionally joined and adapted for coiling-up when the axle 42 is rotated for uncoiling the compressive strap 70, assuming that the strap 70 had been previously wound around the axle 70 when the coil springs were relaxed. By pulling the strap 70 to uncoil it as shown in FIG. 1, the axle 42 is rotated and tightens the springs 40 to store mechanical potential energy therein. When the apparatus is clamped onto the floor boards, this energy is partially released by drawing the boards together as seen in FIGS. 2 and 4.

The second plate 50 further comprises a hand gripping means 80 such as the handle shown in the figures, for pulling the second plate 50 away from the first plate 10 so as to install a biasing energy into the biasing means 40.

The compression strap may alternately be made from an elastic material for providing a further storing of biasing energy.

Figure 6:
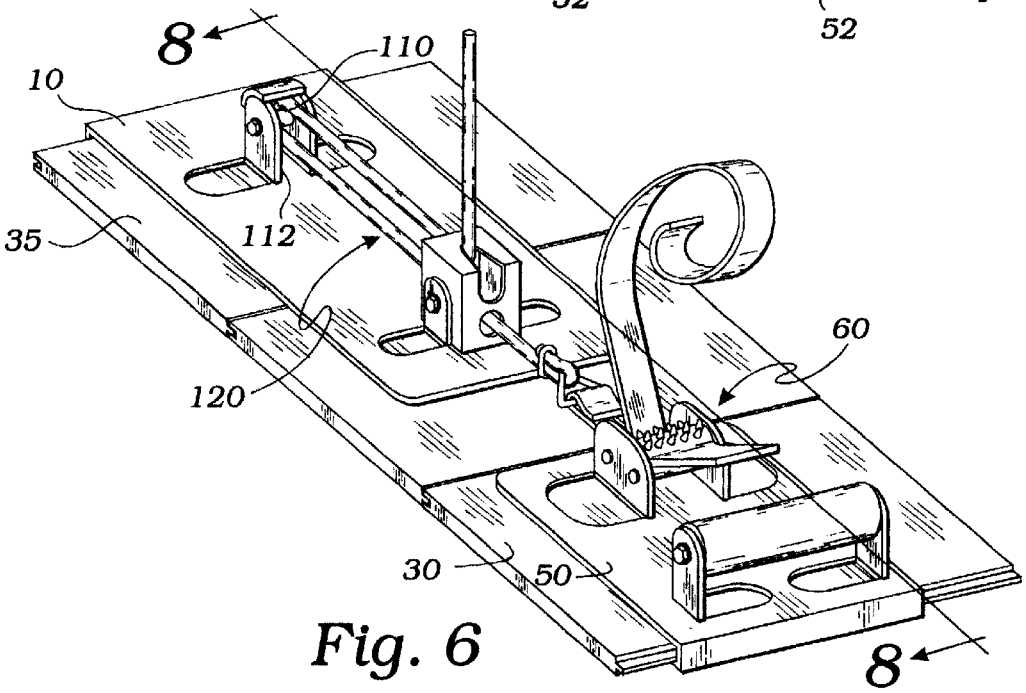
FIG. 6 is a further perspective view demonstrating the method of use thereof.
Figure 7:
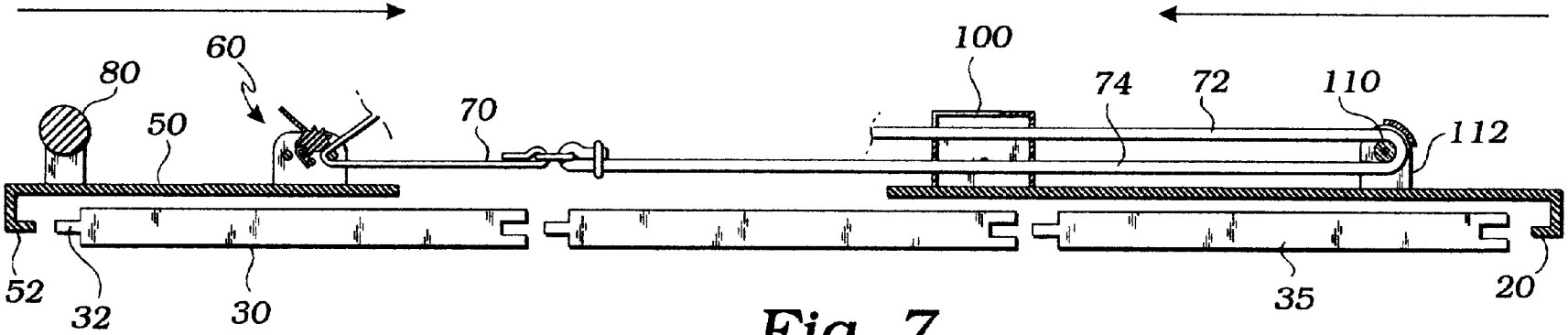
FIGS. 7 and 8 are sectional side elevational views thereof taken along lines 7—7 and 8—8 in FIGS. 5 and 6 respectively.
Figure 8:
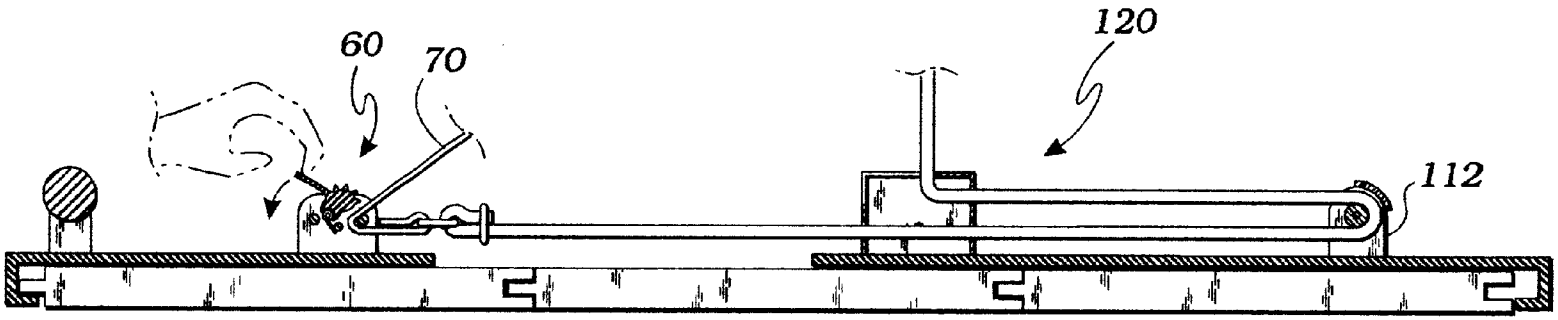

In a further embodiment, the first plate 10 supports a fixed post 100 and a reversing axle 110. The reversing axle 110 is free to rotate supported by two spaced apart standoffs 112. It may use a pulley 114. The fixed post 100 and reversing axle 110 are mutually distally spaced apart as shown in FIGS. 5–8. The biasing means, in this case at least one elastic cord 120, is joined between the fixed post 100 and the compression strap 70. The elastic cord 120 is routed to form a first cord leg 72 between the fixed post 100 and the reversing axle 110 which it is wound around, and a second cord leg 74 between the reversing axle 110 and the compression strap 70. The first and second cord legs 72, 74 are positioned side-by-side as is clearly shown in FIGS. 5 and 7. As with all elastic members, the elastic cord 120 has a unitless stretch modulus defined as the maximum length of stretch prior to fiber rupture, per unit length of cord. Therefore, the maximum linear dimensional elastic deformation of the cord 120 depends only on its original length and its stretch modulus. The configuration disclosed in FIGS. 5–8 therefore, provides a significantly greater total length of stretch than would a similar elastic cord without the reversing feature shown. This allows the invention to be used in situations requiring a greater total clamping span. Also, since the maximum clamping force developed by the elastic cord 120 is the product of its spring constant and its total stretch length, the present invention provides a convenient way to apply a greater range of clamping force, i.e., through the use of clamping means 60 whereby the compression strap 70 may be inserted to any degree desired and clamped at that point as illustrated in FIG. 6.

In operation, the floor boards are placed onto a surface upon which they are to be installed such as a concrete slab. The boards are moved into contact or near contact with each other. The compression strap 70 is clamped at clamping means 60 at an appropriate point. The flange 20 is brought into engagement with the edge 32 and the handle 80 is used to then pull the second plate 50 away from the first plate 10 while storing biasing energy in the biasing means 40 or 120. The flange 52 is then joined with board edge 37 and the handle 80 is released. Biasing energy stored in the biasing means 40 or 120 is then released to help draw the boards into engagement and/or to hold them in place while a cement (not shown) sets.

In the preferred method of the present invention, the plurality of the floor boards 30, 35 etc., for being laid as the floor are provided. The method includes gripping the first floor board 30 with the first gripping means 20 of the first plate 10, the first plate resting on the first floor board; gripping the further floor board 35, distanced from the first floor board 30, with the second gripping means 52 of the second plate 50, the second plate resting on the second floor board 35; joining the first and second plates 10, 50 with the compression biasing means 74 joined in line with the compression strap 70, the biasing means 74 mounted on the first plate 10 and the compression strap removably engaged with the second plate 50; drawing the first 30 and further 35 floor boards into compression therebetween by tightening the compression strap 70 so as to increase the biasing force of the biasing means 74; and repeating these steps until all of the floor boards are laid. As defined above, the method preferably includes the step of providing an elastic cord as the biasing means 74, and further drawing the elastic cord between the fixed post 100 and the reversing axle 110 mutually distally spaced on the first plate 10 so as to form the first cord leg between the fixed post 100 and the reversing axle 110, and the second cord leg between the reversing axle 110 and the compression strap 70, the first and second cord legs positioned in side-by-side adjacency.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An apparatus for compressing floor boards, the apparatus comprising in combination with the floor boards:

a first plate including a first edge gripping means engaging an edge of a first floor board, and a compression biasing means;

a second plate including a second edge gripping means engaging an edge of a second floor board, and a strap clamping means; and a compression strap joined with the biasing means and engaging the strap clamping means, the biasing means enabled for drawing the first and second floor boards into compression.

2. The apparatus of claim 1 wherein the biasing means is at least one coil spring and wherein the at least one coil spring is functionally joined to a free axle, the free axle adapted for coiling-up the compressive strap, the at least one coil spring mounted for storing energy as the compressive strap is uncoiled from the free axle.

3. The apparatus of claim 2 wherein the second plate further comprises a hand gripping means for pulling the second plate away from the first plate so as to install a biasing energy into the biasing means.

4. The apparatus of claim 3 wherein the compression strap is of an elastic material.

5. The apparatus of claim 1 wherein the first plate supports a fixed post and a reversing axle, the fixed post and reversing axle mutually distally spaced, the biasing means comprising at least one elastic cord joined between the fixed post and the compression strap and forming a first cord leg between the fixed post and the reversing axle, and a second cord leg between the reversing axle and the compression strap, the first and second cord legs positioned side-by-side.

6. The apparatus of claim 5 wherein the second plate further comprises a hand gripping means for pulling the second plate away from the first plate so as to install a biasing energy into the biasing means.

7. The apparatus of claim 6 wherein the compression strap is of an elastic material.

8. A method of compressing floor boards, the method comprising the steps of:

a) providing a plurality of floor boards for being laid;

b) gripping a first floor board with a first gripping means of a first plate, the first plate resting on the first floor board, the first gripping means engaging an edge of the first floor board;

c) gripping a further floor board, distanced from the first floor board, with a second gripping means of a second plate, the second plate resting on the second floor board, the second gripping means engaging an edge of the second floor board;

d) joining the first and second plates with a compression biasing means joined in line with a compression strap, the biasing means mounted on the first plate and the compression strap removably engaged with the second plate;

e) drawing the first and further floor boards into compression therebetween by tightening the compression strap so as to increase a biasing force of the biasing means; and f) repeating step (c) through (e) until all of the floor boards are laid.

9. The method of claim 8 further comprising the step of providing an elastic cord as the biasing means, and further drawing the elastic cord between a fixed post and a reversing axle mutually distally spaced on the first plate so as to form a first cord leg between the fixed post and the reversing axle, and a second cord leg between the reversing axle and the compression strap, the first and second cord legs positioned in side-by-side adjacency.

* * * * *